United States Patent [19]

Hayashimoto

[11] 4,204,320

[45] May 27, 1980

[54] SPROCKET SHAFT STAY

[75] Inventor: Youichi Hayashimoto, Hiroshima, Japan

[73] Assignee: Shindaiwa Kogyo Co., Ltd, Hiroshima, Japan

[21] Appl. No.: 970,873

[22] Filed: Dec. 18, 1978

[30] Foreign Application Priority Data

Aug. 18, 1978 [JP] Japan ..... 53/114035[U]
Sep. 28, 1978 [JP] Japan ..... 53/119728[U]

[51] Int. Cl.[2] ..... B27B 17/02
[52] U.S. Cl. ..... 30/386
[58] Field of Search ..... 30/386, 385, 384, 383, 30/382

[56] References Cited

U.S. PATENT DOCUMENTS

| | | | |
|---|---|---|---|
| 830,860 | 9/1906 | Smith | 30/386 |
| 2,774,395 | 12/1956 | Tweedie | 30/386 |
| 2,933,112 | 4/1960 | Bentley | 30/386 |
| 3,157,211 | 11/1964 | Wiig | 30/386 |
| 3,680,608 | 8/1972 | Emmerich | 30/383 |

*Primary Examiner*—Jimmy C. Peters
*Attorney, Agent, or Firm*—Cushman, Darby & Cushman

[57] ABSTRACT

A novel stay for supporting an end of the sprocket shaft secured to the transmission unit in a chain saw is provided according to this invention. The sprocket shaft stay according to this invention comprises a disc-shaped sprocket holder having a central hole for passing the sprocket shaft and a leg piece formed integral with said sprocket holder and extending radially therefrom. The stay of this invention is fixed in position by first fitting said disc-shaped sprocket holder on the sprocket shaft and then inserting said leg piece between the chain saw cover and the saw chain guide bar and securing it by bolts. This provides a support for pivotally supporting one end of the sprocket shaft.

3 Claims, 4 Drawing Figures

SPROCKET SHAFT STAY

BACKGROUND OF THE INVENTION

This invention relates to a stay for pivotally supporting the sprocket shaft of the transmission unit in a chain saw.

In the conventional electric-powered chain saws of the type in which the motor rotation is reduced in speed by using a spur gear or helical gear train, there are usually provided a pair of bearing units for pivotally supporting the sprocket shaft of the final stage, so that very troublesome works were involved, such as removing one of the chain saw covers, many bolts and other parts, for making repairs, setting, replacement and other works on the saw chain. For avoiding such troublesomeness, it has been attempted to adopt a cantilever support for the sprocket shaft. However, in order to keep the shaft proof against bending or break under the tension load exerted to the saw chain, it was required to provide the shaft with sufficient thickness, necessarily resulting in enlarged size and increased weight of the transmission mechanism.

The present invention is intended to eliminate such defects inherent to the conventional chain saws.

OBJECTS OF THE INVENTION

The principal object of this invention is to provide a sprocket shaft stay which is perfectly free of said defects of the conventional chain saws and which is simple in construction, light in weight and very easy to mount in or demount from a chain saw.

Another object of this invention is to provide a sprocket shaft stay which can greatly facilitate repairs, setting, replacement and other works on the saw chain.

Still another object of this invention is to provide a sprocket shaft stay which makes it possible to use a thin sprocket shaft and hence allows reduction in size and weight of the transmission mechanism.

Other objects and advantageous features of this invention will become apparent from the following more detailed description of the invention and the appended claims.

SUMMARY OF THE INVENTION

In order to accomplish the said objects, there is provided according to this invention a sprocket shaft stay comprising a disc-shaped sprocket holder having a central hole for passing the sprocket shaft and a leg piece extending radially from said sprocket holder, said leg piece being inserted between the chain saw cover and the saw chain guide bar and fixed in that state.

The leg piece is bent into a suitable configuration to meet the difference (in level) between the inner side position of the sprocket holder pressing against the outer side surface of the sprocket secured to a bevel gear and the inner side position of said leg piece abutting against the wall surface of the chain saw cover.

The sprocket holder and leg piece constituting the sprocket shaft stay of this invention are preferably molded integral with each other from a metallic material.

BRIEF DESCRIPTION OF THE DRAWINGS

The accompanying drawings are diagrammatic illustrations of a sprocket shaft stay according to this invention, wherein.

DETAILED DESCRIPTION OF THE INVENTION

Before enlarging upon the sprocket shaft stay according to this invention, a brief explanation is made on a motor-driven chain saw in which the sprocket shaft stay of this invention is adapted.

Figure 1:
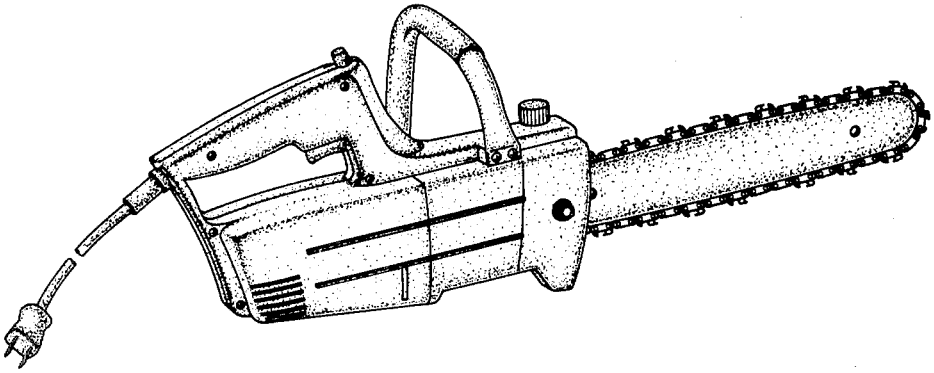
FIG. 1 is a perspective view of a motor-driven chain saw in which a sprocket shaft stay according to this invention is adapted.

FIG. 1 is a perspective view of a motor-driven chain saw in which a motor is mounted longitudinally of the saw. The operator operates the saw by holding its handle.

Figure 2:
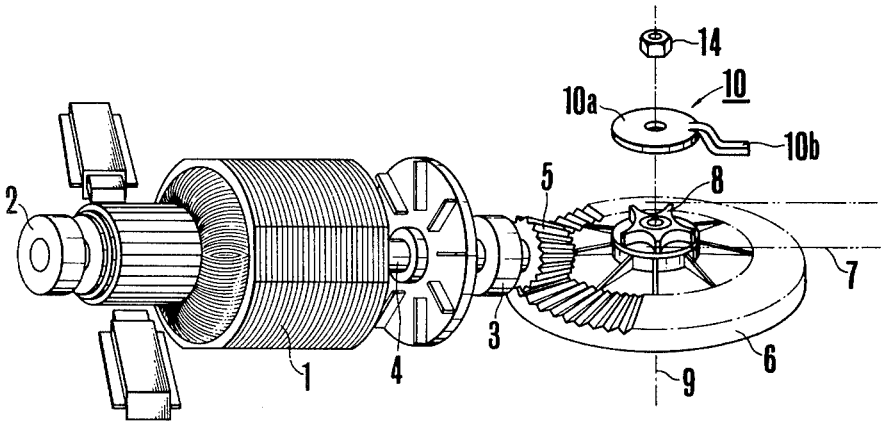
FIG. 2 is a perspective view of the chain saw of FIG. 1 with its case cover removed to show the internal motor and transmission arrangements.
Figure 3:
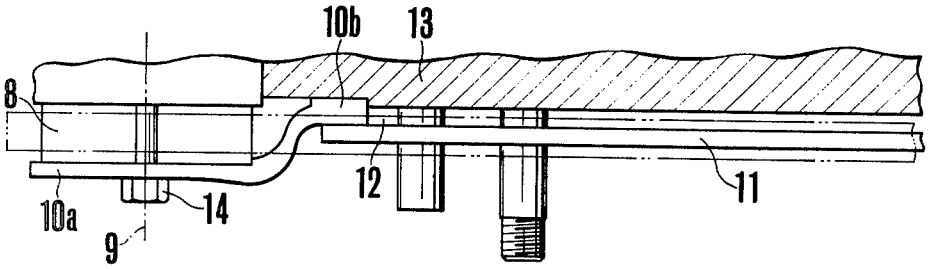
FIG. 3 is a top plan view, with parts shown in section, of a sprocket shaft stay according to this invention, said stay being secured in position between the chain saw cover and saw chain guide bar.
Figure 4:
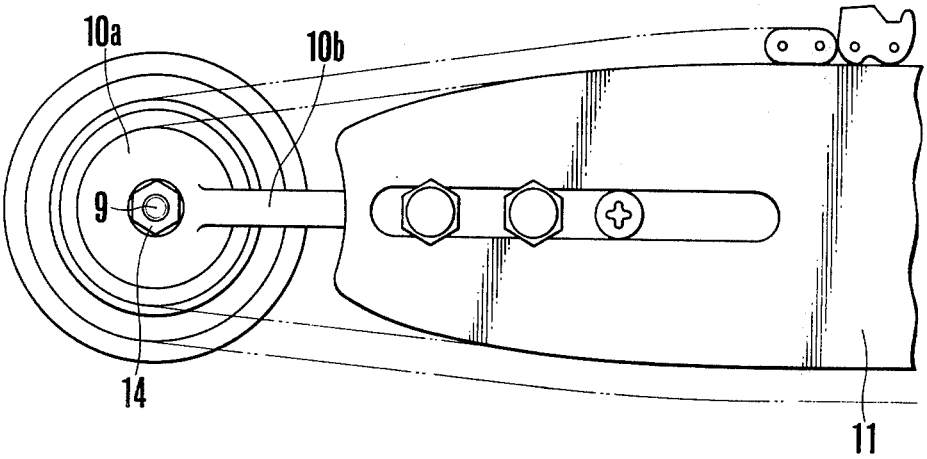
FIG. 4 is a side elevational view of FIG. 3.

As shown in FIG. 2, the motor 1 is supported at the pertinent position in the chain saw cover by means of bearings 2, 3. The rotational torque of the motor is reduced by a gear train comprising a bevel pinion 5 mounted at an end of the motor shaft 4 and a bevel gear 6 meshed with said bevel pinion 5 and is transmitted to the bevel gear axis which is displaced by 90° from the motor axis. Secured to said bevel gear 6 is a sprocket 8 which actuates the saw chain 7.

The shaft 9 passed through the bevel gear 6 axially thereof is pivotally secured at its one end to the chain saw cover while the other end thereof is pivotally secured by a sprocket shaft stay 10 of this invention.

The sprocket shaft stay 10 according to this invention, as best appreciated from FIG. 2, consists of a discoidal sprocket holder **10*a* having a central hole for passing the shaft 9 and a leg piece 10*b* formed integral with said sprocket holder 10*a* and extending radially therefrom. Said leg piece 10*b* is inserted properly into a groove 12 formed in the saw chain cover 13 and then bolted, whereby said leg piece is secured in its position between the saw chain cover 13 and the chain saw guide bar 11. After the sprocket shaft stay 10 of this invention has been properly fixed in position as described above, a nut 14 is screwed on the thread formed at the corresponding end of the sprocket shaft 9 to thereby secure the sprocket shaft 9** in a stable state.

It will be easily understood from the foregoing explanation that if the sprocket shaft stay 10 of this invention is not provided, the shaft 9 must be cantilevered and hence, in such case, there arises a risk of bending or break of the shaft under the tension of the saw chain, and for avoiding such trouble, it needs to sufficiently thicken the shaft.

Another advantageous feature of this invention is that since the saw chain guide bar can be secured to the chain saw cover with the sprocket shaft stay of this invention being properly held therebetween, mounting and demounting of both saw chain guide bar and saw chain can be effected with ease to greatly facilitate repairs, setting, replacement and other works on the saw chains.

What is claimed is:

1. A sprocket shaft stay comprising a sprocket holder secured to a sprocket by bolting and a leg piece extending from said sprocket holder and fixed in position between the chain saw cover and saw chain guide.

2. A sprocket shaft stay according to claim 1, wherein said leg piece is properly bent to meet the difference in level between the inner side position of said sprocket holder pressing against the outerside of the sprocket and the inner side position of said leg piece abutting against the wall surface of the chain saw cover.

3. A sprocket shaft stay according to claim 1, wherein said both sprocket holder and leg piece are molded integral with each other from a metallic material.

* * * * *

UNITED STATES PATENT AND TRADEMARK OFFICE

CERTIFICATE OF CORRECTION

PATENT NO. : 4,204,320

DATED : May 27, 1980

INVENTOR(S) : Youichi Hayashimoto

It is certified that error appears in the above—identified patent and that said Letters Patent is hereby corrected as shown below:

On the title page, item /30/ should appear as follows:

-- /30/ FOREIGN APPLICATION PRIORITY DATA

| | | | |
|---|---|---|---|
| Aug. 18, 1978 | /JP/ | Japan | 53/114035/U/ |
| Sep. 28, 1978 | /JP/ | Japan | 53/119728 |

Signed and Sealed this

*Eighteenth* Day of *November 1980*

[SEAL]

*Attest:*

SIDNEY A. DIAMOND

*Attesting Officer*

*Commissioner of Patents and Trademarks*